US007798683B2

(12) United States Patent
Swanson

(10) Patent No.: US 7,798,683 B2
(45) Date of Patent: Sep. 21, 2010

(54) TORCHIERE FLOOR LAMP HAVING HIDDEN LIGHT

(75) Inventor: Dennis K. Swanson, Woodland Hills, CA (US)

(73) Assignee: Lamps Plus, Inc., Chatsworth, CA (US)

( * ) Notice: Subject to any disclaimer, the term of this patent is extended or adjusted under 35 U.S.C. 154(b) by 138 days.

(21) Appl. No.: 12/277,233

(22) Filed: Nov. 24, 2008

(65) Prior Publication Data

US 2010/0128477 A1 May 27, 2010

(51) Int. Cl.
*F21S 8/08* (2006.01)

(52) U.S. Cl. ..... 362/414; 362/431; 362/153

(58) Field of Classification Search ..... 362/153, 362/431, 403, 410, 411, 413, 414
See application file for complete search history.

(56) References Cited

U.S. PATENT DOCUMENTS 1,456,194 A * 5/1923 Rosenberg ..... 362/388
4,562,521 A * 12/1985 Noguchi ..... 362/433
5,221,141 A * 6/1993 Swanson ..... 362/249.05
5,653,531 A * 8/1997 Yang ..... 362/352
6,821,010 B2 * 11/2004 Lo ..... 362/555

* cited by examiner

*Primary Examiner*—Gunyoung T Lee
(74) *Attorney, Agent, or Firm*—Connolly Bove Lodge & Hutz LLP; Billy A. Robbins

(57) ABSTRACT

A floor lamp having a hidden first light source intermediate the base and the top of the lamp with an elongated tubular shade enclosing the space within in which the first light source is disposed and defining the outer periphery thereof and obscuring the first light source. A plurality of legs in the form of slat like members having a thickness and a width are equi-angularly disposed and rise from a base. A torchiere is supported at the top of the legs in order to provide illumination by a general area lighting source. The slat like legs define a centrally disposed inner space which receives the first light source, as well as a stem rising from the base and carrying electrical wiring to provide electrical energy to the first light source and the general area light source. A canopy is secured to the upper ends of the slat like legs to maintain them in position to define the centrally disposed inner space.

9 Claims, 3 Drawing Sheets

TORCHIERE FLOOR LAMP HAVING HIDDEN LIGHT

FIELD OF THE INVENTION

The present invention relates generally to lighting apparatus and more particularly to a floor lamp which includes a lighting means intermediate the top and bottom thereof which is obscured by a shade and also includes a torchiere at the upper end thereof.

BACKGROUND OF THE INVENTION

Floor lamps of various types and construction are well known in the prior art. Typically, such lamps include a base which rests upon the floor and supports the lamp and includes a stem rising typically from the center of the base with general area lighting means at the upper end of the stem. Such lamps may also include one or more task lights which are connected to the stem. The general area lighting means may be in the form of a typical bulb surrounded by a shade or alternatively a torchiere type of structure. In some instances, the stem of the floor lamp may be constructed of a translucent material which defines a chamber within which there is disposed a low light level source for providing night light or alike. Applicant is unaware of any floor lamp which includes in the body thereof a light source which is obscured by a shade surrounding the light source and which further includes a torchiere mounted at the upper end of the body.

SUMMARY OF THE INVENTION

The present invention is directed to a floor lamp which has a base with a plurality of legs equi-angularly spaced apart affixed to the base and extending upwardly therefrom. A light source is disposed intermediate the upper and lower ends of the legs within an inner space defined by the legs. A canopy is affixed to the upper end of the legs and supports a general area of lighting means in the form of a torchiere while a tubular shade is disposed within the legs and is supported at its lower end on the legs with the shade defining the outer periphery of the inner space and obscuring the light source disposed therein.

DETAILED DESCRIPTION

Figure 1:
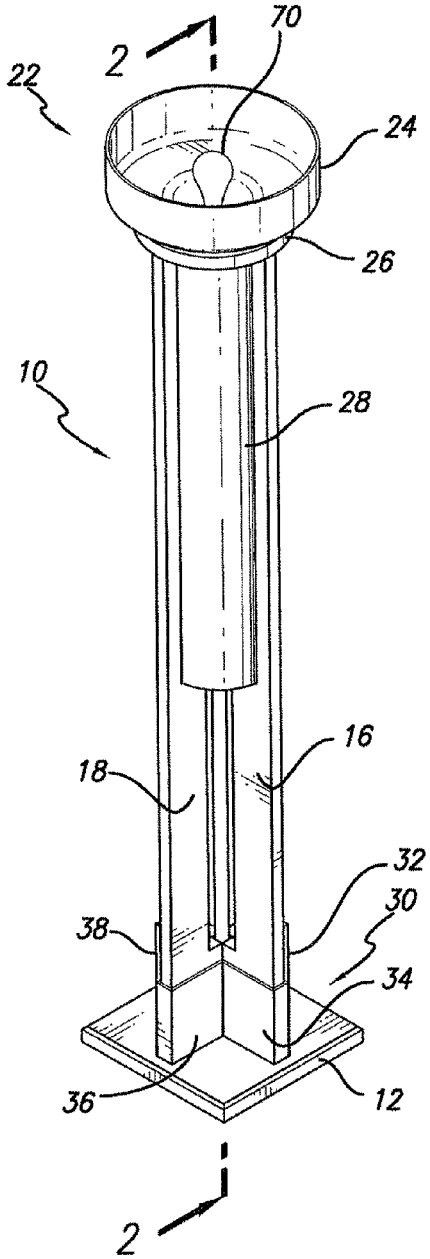
FIG. 1 is a perspective view of a floor lamp constructed in accordance with the present invention.

Referring more particularly to FIG. 1, the lamp 10 constructed in accordance with the principles of the present invention is illustrated in a perspective view. The lamp 10 includes a base 12 for supporting the lamp upon the floor. A plurality of legs 14, 16, 18 and 20 are equi-angularly disposed upon the base 12 and extend upwardly therefrom to the upper end of the lamp 10. In accordance with the preferred embodiment of the lamp of the present invention there are four such legs but it should be understood that there may be three or more of such legs without departing from the scope of the present invention. A torchiere 22 is supported upon the upper end of the legs 14 through 20. The torchiere 22 includes an upwardly directed shade or reflector 24 within which a general area light source is disposed. The shade 24 is supported upon a canopy 26 which is secured to the upper ends of the legs. A tubular shade 28 is disposed within the legs and is supported upon its lower end on the legs and obscures a light source which is disposed internally within a centrally disposed inner space formed by the legs 14 through 20. It will be recognized by those skilled in the art that the legs 14 through 20 are preferably in the form of a slat like member having a width and a thickness. A hollow metal plate 30 is supported on the upper surface of the base 12 and has a plurality of arms 32, 34, 36 and 38 equal in number to the number of legs the lower end of each of the legs is carried by one of the arms of the hollow metal plate 30.

Figure 3:
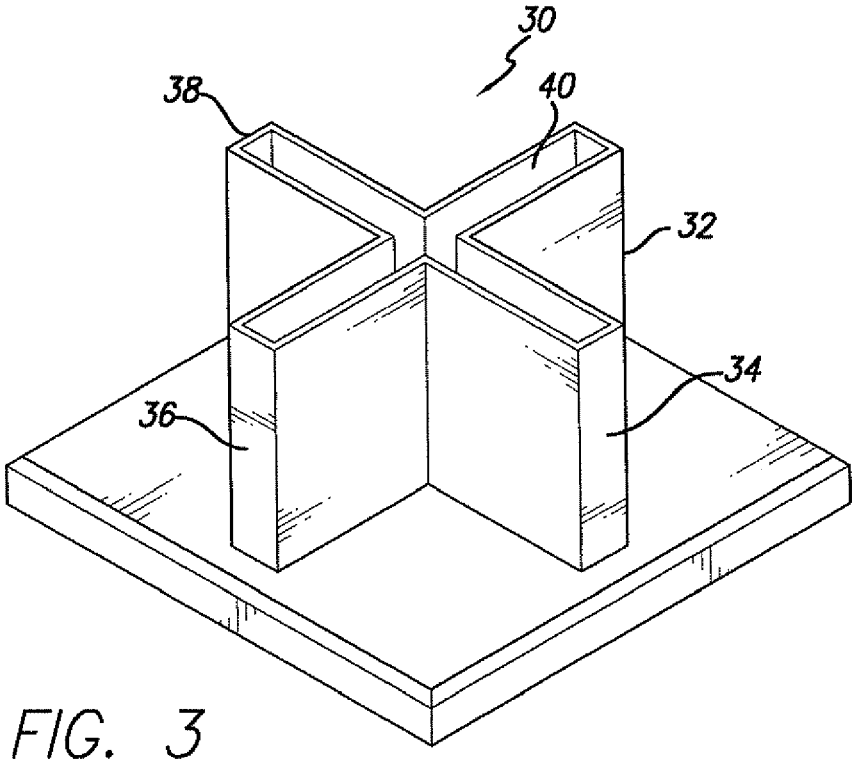
FIG. 3 is a perspective view of a hollow plate supported upon the base and which in turn supports the legs.

The construction of the hollow metal plate 30 will be better understood by reference to FIG. 3 which is a perspective view of the hollow metal plate 30. As is therein shown the hollow metal plate 30 is cruciform in structure and is hollow as shown at 40. The legs 14 through 20 are constructed at their lower ends in such a manner that each of the legs fits within the hollow portion of one of the arms 32 through 38 and thus, supports the legs in a manner to prevent movement thereof at the lower portion. The base 12 supports the hollow metal plate 30 preferably by fasteners which are inserted through the bottom of the base 12 into threaded openings formed in the bottom of the hollow metal plate 30.

Figure 2:
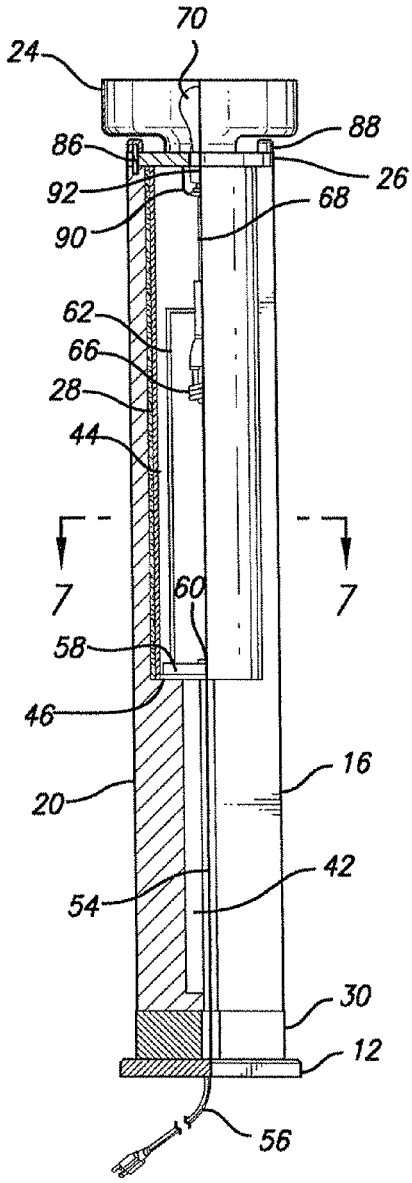
FIG. 2 is a partial cross-sectional view taken about the lines 2-2 of FIG. 1.
Figure 7:
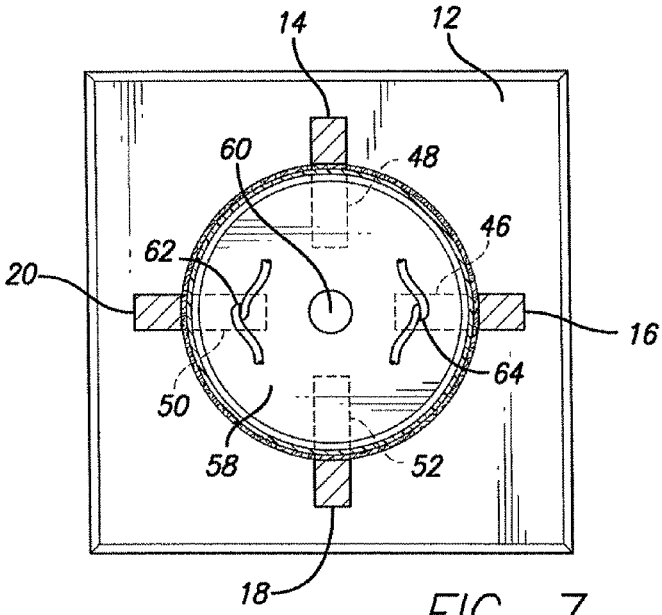
FIG. 7 is a cross-sectional view taken about the lines 7-7 of FIG. 2.

As seen more clearly in FIGS. 2 and 7 to which reference is hereby made each of the plurality of legs has a thickness and a width. The width of each of the legs is reduced adjacent the upper end of the hollow metal plate 30 to define a centrally disposed inner space 42. The width is again further reduced at a point intermediate the upper and lower ends of the slat like legs to define an enlarged inner space 44. By the second reduction in width of each of the slat like legs there is produced a shoulder such as shown in 46, 48, 50 and 52 on each of the legs. A centrally disposed hollow stem 54 is centrally disposed and extends through the center portion of the hollow metal plate 30 and is affixed to the base 12. The hollow stem 54 receives electrical wiring 56 to provide energy to the light sources for the lamp 10. The hollow stem 54 terminates in a junction box 58 which is supported on the shoulders 46 through 52 and it is held in place by a fastener 60. The electrical wiring 56 branches out within the junction box 58 and extends through additional parallel hollow tubes 62 and 64 to provide electrical energy to the first light source 66 supported internally of the enlarged inner space 44 and then upwardly through an extension of the stem 68 to the second light source 70 and the torchiere 22.

As is illustrated more clearly in FIG. 1, the shade 28 is an elongated tubular shade preferably constructed of a translucent material which rests upon the shoulders 46 through 52 and extends from the shoulders to the canopy 26. By extending over this length it defines the outer periphery of the enlarged inner space 44 and at the same time obscures the first light source 66 as well as the hollow tubing providing the wiring for the first and second light sources. Preferably the shade 28 is constructed from a translucent plastic material such as polystyrene and has the outer surface thereof coated with a fabric which may be adhered by an adhesive or the like while maintaining the translucent function of the shade 28 to allow light from the first light source 66 to pass there through to provide light for the surrounding area but at a somewhat subdued level.

Figure 4:
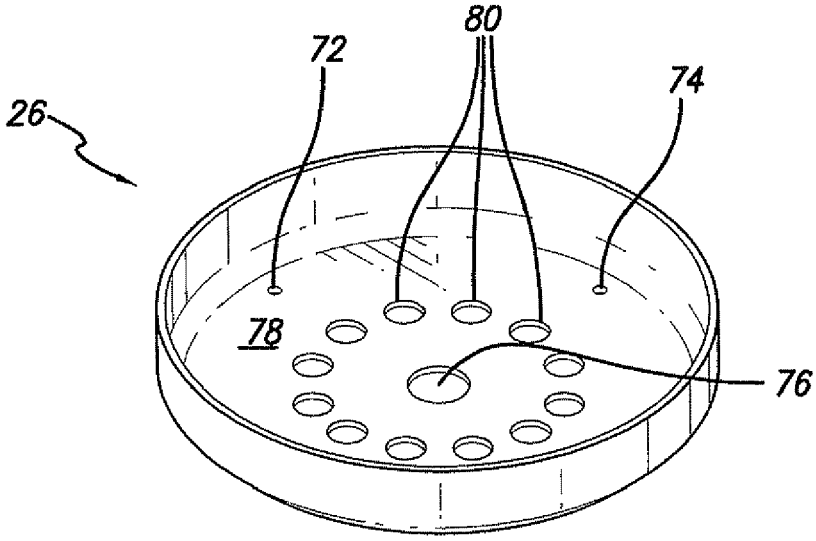
FIG. 4 is perspective view of the canopy of the lamp.
Figure 5:
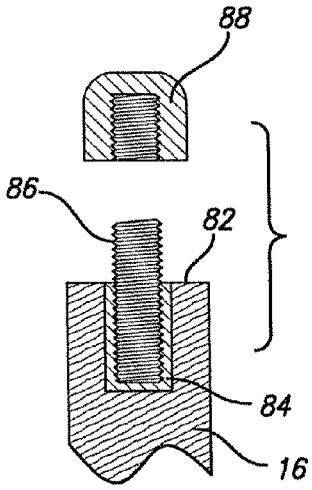
FIG. 5 illustrates fasteners utilized to retain the canopy in place.

As shown in FIG. 4, the canopy 26 is constructed of sheet metal which has been formed into a pan like configuration. The canopy 26 has a plurality of openings equivalent to the number of legs provided about the outer edge thereof, two of which are shown at 72 and 74. A centrally disposed opening 76 is defined in the bottom 78 of the canopy 76. A plurality of openings as shown at 80 are disposed about the central opening 76. The openings 80 are utilized to allow heat which may be generated within the enlarged interior space 44 to escape therefrom. The canopy 26 is secured to the top of each of the legs 14 through 20 by a fastener as illustrated in FIG. 5. As is therein shown the leg 16 has an opening formed in the upper surface 82 thereof and a threaded sleeve 84 is inserted therein. A threaded stud 86 is then threaded into the sleeve 84 and extends through one of the openings such as 72 or 74 about the outer portion of the canopy 26. A nut 88 is then threaded onto the upper threaded portion of the stud 86 to hold the canopy in place.

Figure 6:
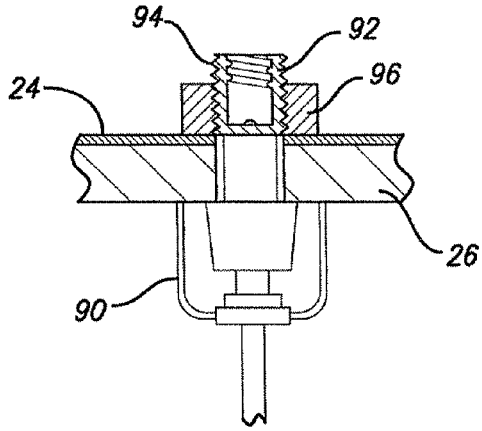
FIG. 6 is a partial view illustrating the manner in which the torchiere shade is retained on the lamp.

The shade or reflector 24 of the torchiere 22 may be constructed of any material desired. It may for example, be constructed of a translucent frosted white glass, a plastic material or if it is to function more effectively as a reflector may include a metal member or have a plastic shade with a metalized inner surface therein to better reflect the illumination from the second light source 70 upwardly and thereby provide greater illumination for general area lighting around the lamp 10. As is illustrated in FIG. 2 a metal socket cup 90 is supported on the upper end of the stem extension 68 and has disposed internally thereof a socket 92 for receiving the second light source 70. This is shown in greater detail in FIG. 6 and as is therein shown a socket 92 has threads 94 formed on the exterior surface thereof. A threaded ring 96 is threadably received on the threads 94 on the external surface of the socket 92 and functions to retain the shade or reflector 24 in place on the canopy 26. If it is desired to replace the first light source 66, such may be accomplished by removing the ring 96 and the shade 24. Thereafter the plurality of nuts 88 may be removed to remove the canopy 26 after which the shade 28 may be extracted and access to the first light source 66 provided.

It should be understood by those skilled in the art that although the plurality of legs 14 through 20 are preferably constructed of wood to provide a rich appearance to the lamp that such may be constructed of plastic or metal as may be desired without departing from the spirit or scope of the present invention as defined by the claims.

There has thus been disclosed a floor lamp which has a first light source disposed within an internal space defined by a plurality of legs and which space is surrounded by an elongated shade of translucent material which obscures the light source with a torchiere supported at the top of the lamp to provide general area lighting.

What is claimed is:

1. A floor lamp comprising:

a. a base for supporting said lamp;

b. a plurality of legs, having lower and upper ends, equiangularly spaced apart with the lower ends affixed to said base and extending upwardly from said base;

c. a first light source disposed intermediate said lower and upper ends of said legs;

d. a canopy affixed to the upper ends of said legs;

e. a tubular shade having a lower end disposed within said legs and supported at its lower end on said legs, said shade defining the outer periphery of said inner space and obscuring said first light source; and f. a general area lighting means including an upwardly directed reflector carried by said canopy and having a second lighting source disposed therein.

2. A floor lamp as defined in claim 1 wherein each of said legs is a slat like member having a width and thickness and wherein said width is reduced over a portion of the length thereof to define said inner space.

3. A floor lamp as defined in claim 2 wherein said reduced width defines a shoulder upon which the lower end of said tubular shade is seated.

4. A floor lamp as defined in claim 2 wherein said slat like legs are constructed of wood, are four in number and the width dimension is radially outwardly disposed.

5. A floor lamp as defined in claim 1 which further includes a hollow stem supported on said base and extending upwardly therefrom within said inner space and electrical wiring disposed within said stem.

6. A floor lamp as defined in claim 1 which further includes a hollow metal plate having a plurality of arms equal in number to the plurality of legs, the lower end of each of said legs being carried by one of said arms.

7. A floor lamp as defined in claim 6 wherein the lower end of each of said legs is received internally of one of said arms.

8. A floor lamp as defined in claim 1 wherein said canopy is metal and defines a plurality of openings disposed adjacent the periphery thereof equal in number to the plurality of legs, the upper end of each of said legs having a threaded stud secured thereto and extending through one of said openings and a nut secured to said stud to secure said canopy in place.

9. A floor lamp as defined in claim 8 wherein said metal canopy defines a central opening there through, a socket for receiving said second lighting source extending through said central opening, said socket having external threads, and a threaded ring engaging said threads on said socket to retain said upwardly directed reflector on said canopy.

* * * * *